US005603277A

United States Patent [19]

Webb

[11] Patent Number: 5,603,277

[45] **Date of Patent: *Feb. 18, 1997**

[54] TACK ABACK SAILBOAT

[76] Inventor: William B. Webb, 313 Park St., Lake City, Minn. 55041

[ * ] Notice: The portion of the term of this patent subsequent to Apr. 8, 2014, has been disclaimed.

[21] Appl. No.: 540,500

[22] Filed: Oct. 10, 1995

Related U.S. Application Data

[63] Continuation-in-part of Ser. No. 403,214, Mar. 13, 1995, abandoned, which is a continuation-in-part of Ser. No. 225,466, Apr. 8, 1994, Pat. No. 5,410,977.

[51] Int. Cl.[6] ..... B63B 15/00

[52] U.S. Cl. ..... 114/61; 114/91

[58] Field of Search ..... 114/39.1, 39.2, 114/61, 89–93, 130, 132, 345

[56] References Cited

U.S. PATENT DOCUMENTS

| | | | |
|---|---|---|---|
| 3,859,943 | 1/1975 | Katainen . | |
| 3,885,512 | 5/1975 | Marcil . | |
| 3,972,300 | 8/1976 | Adamski | 114/91 |
| 3,986,473 | 10/1976 | Truzzi | 114/39.1 |
| 4,067,280 | 1/1978 | Serfess . | |
| 4,102,287 | 7/1978 | Ferris | 114/91 |
| 4,385,579 | 5/1983 | Baulard-Caugan . | |
| 4,766,830 | 8/1988 | Kunz | 114/91 |
| 4,819,574 | 4/1989 | Westerman . | |
| 5,072,682 | 12/1991 | Urroz et al. . | |
| 5,113,775 | 5/1992 | Imhoff . | |
| 5,410,977 | 5/1995 | Webb | 114/61 |

FOREIGN PATENT DOCUMENTS

| | | | |
|---|---|---|---|
| 2742989 | 4/1979 | Germany . | |
| 3830820 | 3/1990 | Germany | 114/91 |

OTHER PUBLICATIONS

High Speed Sailing, p. 93.
Dictionary Excerpt for Proa.

*Primary Examiner*—Edwin L. Swinehart
*Attorney, Agent, or Firm*—Haugen and Nikolai, PA

[57] ABSTRACT

A rudderless sailboat having a hydrodynamic symmetry fore and aft which can be sailed equally well in either direction. The craft is steered by tilting the mast and keel. In an alternative embodiment the sailboat also has no keel. The hulls are rigid and have a v-shaped bottom. While sailing forward, the sail can be rotated past the angle of zero angle-of-attack to that angle-of-attack where the wind is aback on the sail. This stops the boat and causes it to sail back in the general direction from which it came. This sailboat maneuver is called a tack aback.

18 Claims, 4 Drawing Sheets

10
20
32
26
14
24
C.E.
30
32
19
12
18
21
16
P
17
12
18
15
C.L.R.
22

F1
SIDE S
18
12
16
42
A1
M=0
T1
MOVEMENT
A2
22
40
SIDE P
WIND
R
10

SIDE S
18
12
16
42
T2
A1
F=0
NO MOVEMENT
R=0
A2
22
40
SIDE P
WIND
10
T3
18

SIDE S
F1
12
A1
16
50
M=0
MOVEMENT
A2
R
48
22
SIDE P
WIND
10

110
120
132
126
114
124
C.E.
130
132
119
112
118
121
116
P
117
112
118

TACK ABACK SAILBOAT

CROSS-REFERENCE TO RELATED APPLICATION

This is a continuation-in-part of my application Ser. No. 08/403,214, filed Mar. 13, 1995, entitled "RUDDERLESS SAILBOAT, TILT SAIL AND KEEL STEERING WITH INTERCHANGEABLE BOW AND STERN SAILS, now abandoned, " which in turn is a continuation-in-part of application Ser. No. 08/225,466, filed Apr. 8, 1994, entitled "RUDDERLESS SAILBOAT, " now U.S. Pat. No. 5,410, 977.

BACKGROUND OF THE INVENTION

1. Field of the Invention

This invention relates to a sailing craft, and particularly to a sailing craft without a rudder which can be effectively steered by fore-and-aft tilting of sail and keel. Additionally, the craft is hydrodynamically symmetrical fore and aft. It moves through the water identically in either direction. It is thus capable of performing a new sailing maneuver called a "tack aback. " In a tack aback, the craft changes its sailing direction (i.e., tacks) by rotating its boom to the front of the craft and putting the sail aback. This stops the craft and causes the craft to move aback in the general direction from which it came. In a tack aback, unlike all other tacking maneuvers, the wind continues to blow on the same side of the craft throughout the maneuver.

2. Description of the Prior Art

Steering a sailboat without the aid or presence of a rudder is accomplished on a sailboard by tilting the mast (with sail) fore and aft. But the board itself is not hydrodynamically symmetrical fore and aft. Sailboards generally have both a midship fixed fin keel and one aft fixed fin rudder. Their stern and bow are not interchangeable. Sailboards sail only in a forward direction. They cannot tack aback.

U.S. Pat. No. 4,766,830 (Kunz) teaches a sailboat which has twin inflatable hulls for floatation of a catamaran. Each inflatable hull is essentially hydrodynamically symmetrical fore and aft. But the sailboat of the '830 patent is not symmetrical. It has a movable rudder for steering affixed to its stern, and the boat disclosed in the '830 patent cannot tack aback.

U.S. Pat. No. 4,102,287 (Ferris) teaches a catamaran whose mast can swing from straight down in the water to straight up so a capsized boat need not be righted. The swing of the sail is not used for steering and the hulls are not hydrodynamically symmetrical fore and aft. The boat is steered by rudders and the boat cannot tack aback.

U.S. Pat. No. 3,972,300 (Adamski) teaches a sailing craft where mast and keel are free to rotate from side to side so the hull remains level atop the water. This craft is not steerable by mast/keel tilt. It has an aft rudder and is asymmetrical fore and aft so it cannot tack aback.

U.S. Pat. No. 3,986,473 (Truzzi) is a tiller bar steered craft with auxiliary sail whose sail forces aid, to some extent, the steering. The sail/rudder does not tilt. The craft is asymmetrical fore and aft, and cannot tack aback.

OBJECTS

It is accordingly a principal object of the present invention to provide a rudderless sailboat with a reduced hydrodynamic drag.

Still yet a further object of the present invention is to provide a rudderless sailboat which can be easily and precisionally steered.

Still yet a further object of the present invention is to provide a rudderless sailboat concept which is hydrodynamically symmetrical fore and aft and moves through the water equally well in either direction allowing the craft to have its sail move aback forcing the craft to stop and then sail back in the general direction from which it came thus performing a tack aback maneuver.

Other objects, features and advantages of the present invention will become apparent to those skilled in the art through the Description of the Preferred Embodiment, Claims, and drawings herein wherein like numerals refer to like elements.

SUMMARY OF THE INVENTION

The foregoing objects and advantages of the present invention are achieved by providing a rudderless sailboat having a mast with sail and keel assembly selectively pivotable either fore or aft to control steering of the sailboat, and the sailboat's hull and keel are configured to be hydrodynamically symmetrical fore and aft so the boat sails equally well in either direction.

In one embodiment a catamaran, a pair of hulls, each with its bow and stern hydrodynamically symmetrical, are provided with an integral mast and keel vertically extending therebetween, and pivotable fore or aft. A lateral frame member extends to each side from between the foot of the sail and the keel, and is pivotably attached to each respective hull. The keel has a profile and configuration which is hydrodynamically symmetrical about its centerline vertical axis, thereby permitting the craft to be sailed in either the fore or aft direction.

While sailing a point, the angle of attack of the sail may be reduced to zero so the aerodynamic force on the sail becomes negligible and the sailboat's speed drops to zero. Further reduction of the sail's angle of attack puts the wind on the opposite side of the sail (the sail is now said to be "aback"). The aerodynamic forces on the sail aback will now move the sailboat backward in the general direction from where it came. With hydrodynamically symmetrical bow and stern, the embodiment sailboat is now simply moving in a new direction, with the wind still originating from the same side of the sailboat. Tack of the sailboat has been accomplished. The tack maneuver is called "tack aback". Tack abacks may be accomplished with the wind originating on either port or starboard sides of the craft.

DESCRIPTION OF THE PREFERRED EMBODIMENT

Figure 1:
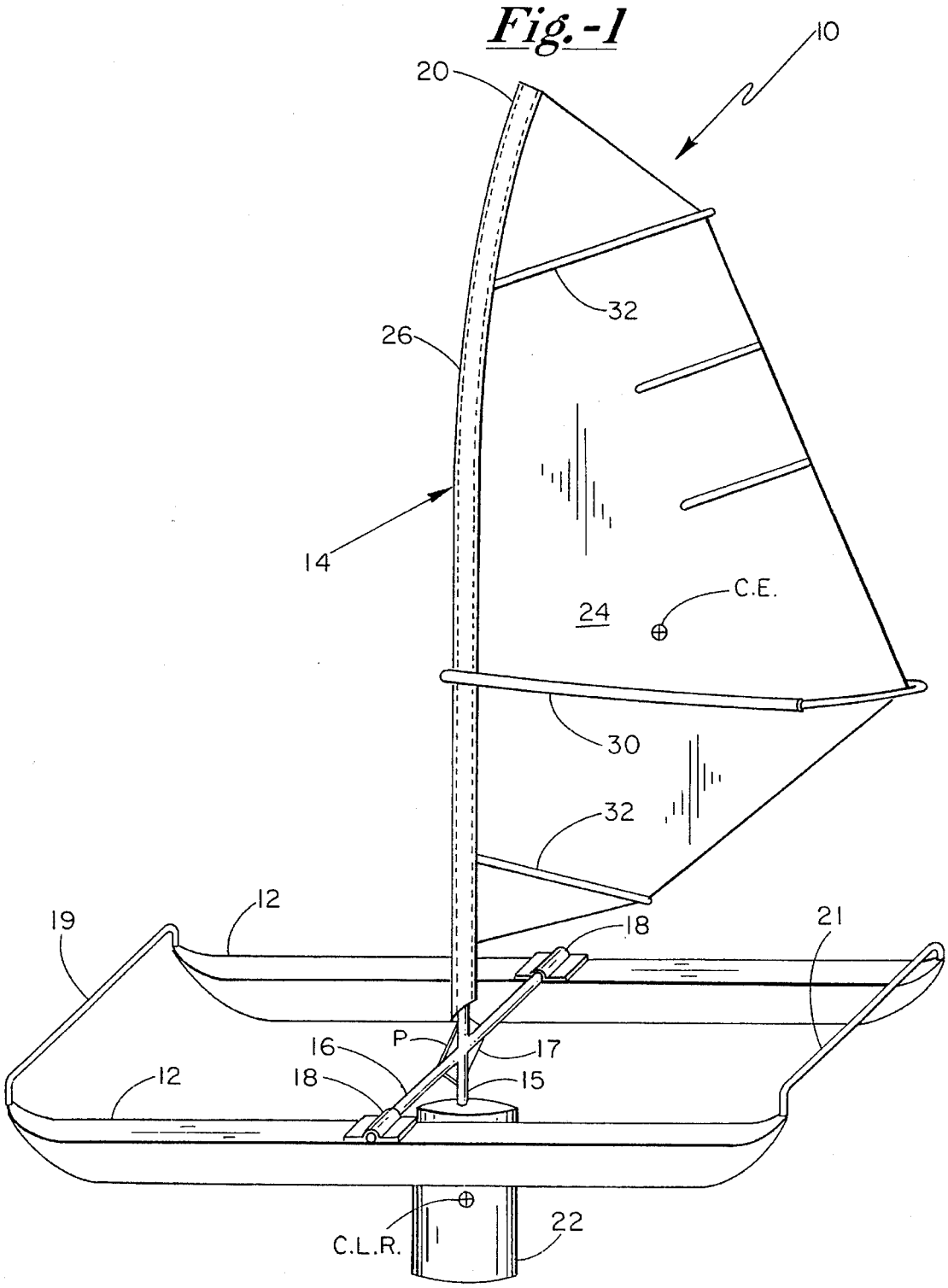
FIG. 1 is a perspective view of a twin hull or catamaran style sailboat wherein the mast extends upwardly from an integral keel, and which is pivotable fore or aft between the hulls therebetween.

Referring to FIG. 1, a rudderless catamaran sailboat is shown generally at 10. Sailboat 10 includes a pair of parallel floatation pontoons 12, and a rigid inflatable mast 14 extending upwardly between the pontoons 12. A rigid mast support 15 includes a pair of opposing rigid frame members 16 rotatably coupled to each pontoon 12. Each member 16 laterally extends from the lower portion of mast support 15 and is secured thereto such as by welding, and includes a gusset 17 providing strength. The opposing distal ends of each frame member 16 are pivotably and rotatably coupled to the upper midsection of the respective pontoon 12. The distal ends are axially disposed through a respective curved bracket 18 secured to the upper surface of the respective pontoon 12, as shown. The distal end of each frame member 16 is restricted from lateral shifting within the respective bracket 18 by a pair of large releasable keeper pins, one pin being disposed through the respective frame member 16 each side of bracket 18. A front tie 19 and a rear tie 21 extend between and are secured to each pontoon 12 to provide torsional strength.

Mast member 14 extends between an upper end 20 and a lower end defined proximate members 16, which lower end terminates at and is secured to a symmetrically configured keel 22. When mast 14 is pivoted forwardly, frame members 16 each rotate within respective bracket 18, and the mast upper end 20 and keel 22 correspondingly rotate about pivot point P (see FIG. 1). A sail 24 is secured to a vertically extending flexible mast sleeve 26 along the forward edge of sail 24, as shown. Sleeve 26 is generally tubular being sewn into and consisting of sail cloth, and is selectively disposed over mast support 15 in a friction fit. A sail boom 30 extends rearward on each side of sail 24 along the major surfaces thereof. A plurality of rigid reinforcing members 32 are provided along the rear edges of sail 24, each extending inwardly towards mast 14, as shown, to reinforce sail 24 and along with boom 30, to maintain an open sail surface.

Referring now to FIG. 1 in view of plan FIGS. 2A, 2B, 2C and 2D, the operational features of this novel rudderless sailboat can be appreciated. By way of demonstration, if it is assumed the wind is blowing from port and thus impinging upon the surface of sail 24 as shown in FIGS. 2A, 2B, 2C and 2D, one can steer sailboat 10 by motioning mast upper end 20 and sail 24 forwardly or rearwardly, along a center axis A2 between the pontoons, such that due to this pivoting motion, keel 22 correspondingly rotates in the opposite direction and about pivot point P.

Figures 2A, 2B, 2C:
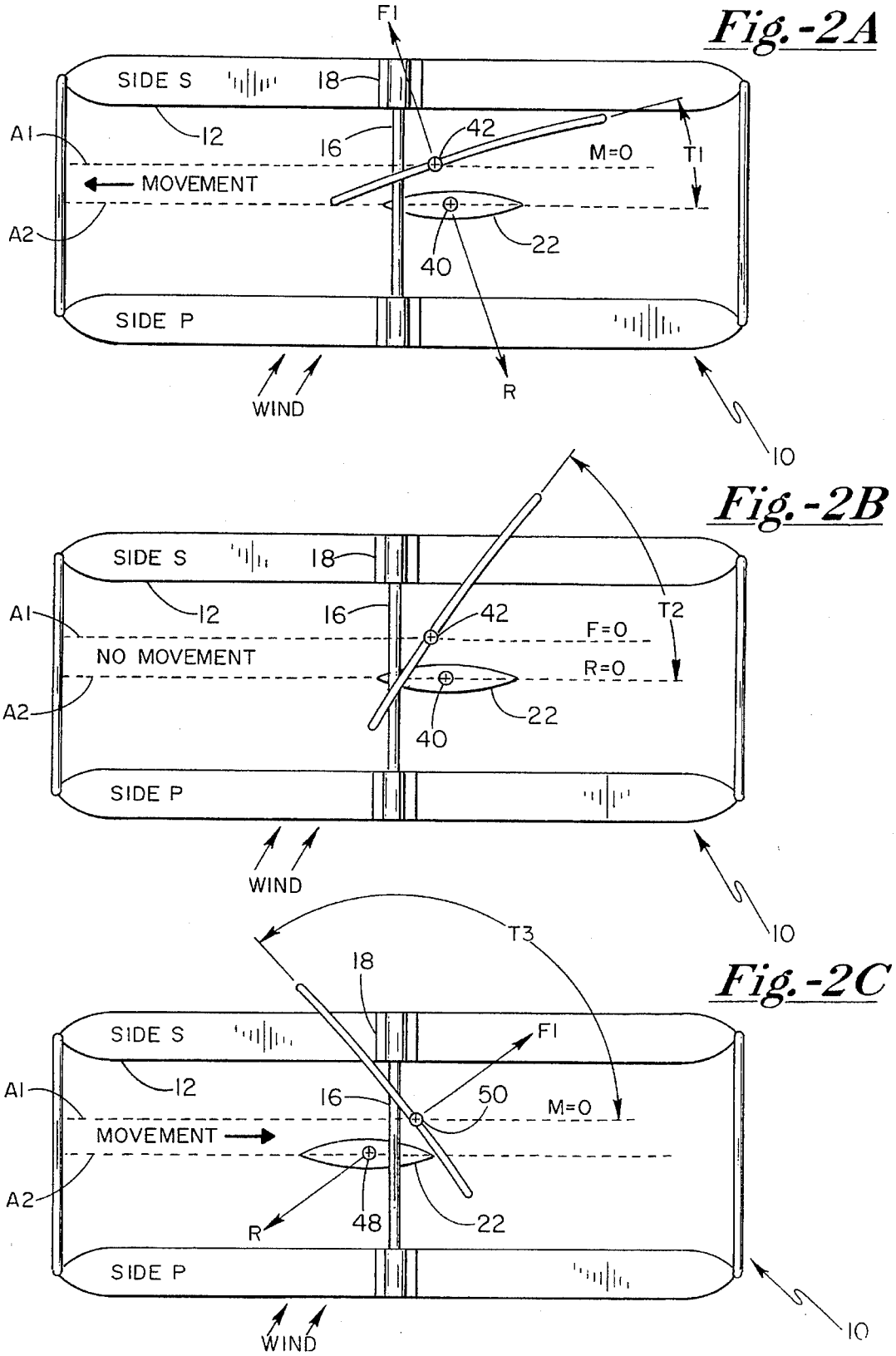
FIG. 2A is a plan view of the catamaran sailboat shown in FIG. 1 illustrating the mast and sail assembly pivoted forwardly with the keel correspondingly rotated rearwardly so the hydrodynamic and aerodynamic forces on the craft are equal and opposite and the craft is moving straight to the left.
FIG. 2B is a plan view showing the sail rotated straight into the wind. Aerodynamic and hydrodynamic forces have gone to zero and the craft is stopped in the water.
FIG. 2C is a plan view showing the sail rotated even further so the sail is aback (wind on the back side of the sail). The boat is now moving back in the general direction from which it came (to the right)

First, referring to FIG. 2A, if sail 24 and mast upper end 20 is tilted slightly forward from that shown in FIG. 1, and keel 22 thus tilted slightly aft, the sailboat will be steered straight forward. The hydrodynamic center of force R extending from the center of lateral resistance (C.L.R.) of keel 22 is generally shown at 40. The aerodynamic center of force F1 is generally shown at 42 and extends from the sail center of effort (C.E.). These forces are equal and opposite and occur in the same vertical plane so no moment of force M1 is generated, and thus, sailboat 10 steers forwardly without turning.

In reference to FIGS. 1 and 2B, if sail 24 and mast upper end 20 are rotated further forwardly increasing the sail trim angle T2 from trim angle T1 in FIG. 2A, while keel 22 remaining as shown, the aerodynamic force F1 on the sail 24 becomes negligible and the sailboat's speed drops to zero.

Conversely, as shown in FIG. 1 and 2C, if sail 24 is pivoted rearwardly such that keel 22 is pivoted forwardly, the hydrodynamic center of force R is shifted forwardly along line A2 to position 48, and the aerodynamic center of force F1 is shifted rearwardly along line A1 to 50. These forces are equal and opposite and occur in the same vertical plane so no movement of force M1 is generated. By increasing the sails angle of attack, the wind is on the opposite side of the sail. The aerodynamic forces on the sail aback will move the sailboat in the general direction from where it came.

Figure 2D:
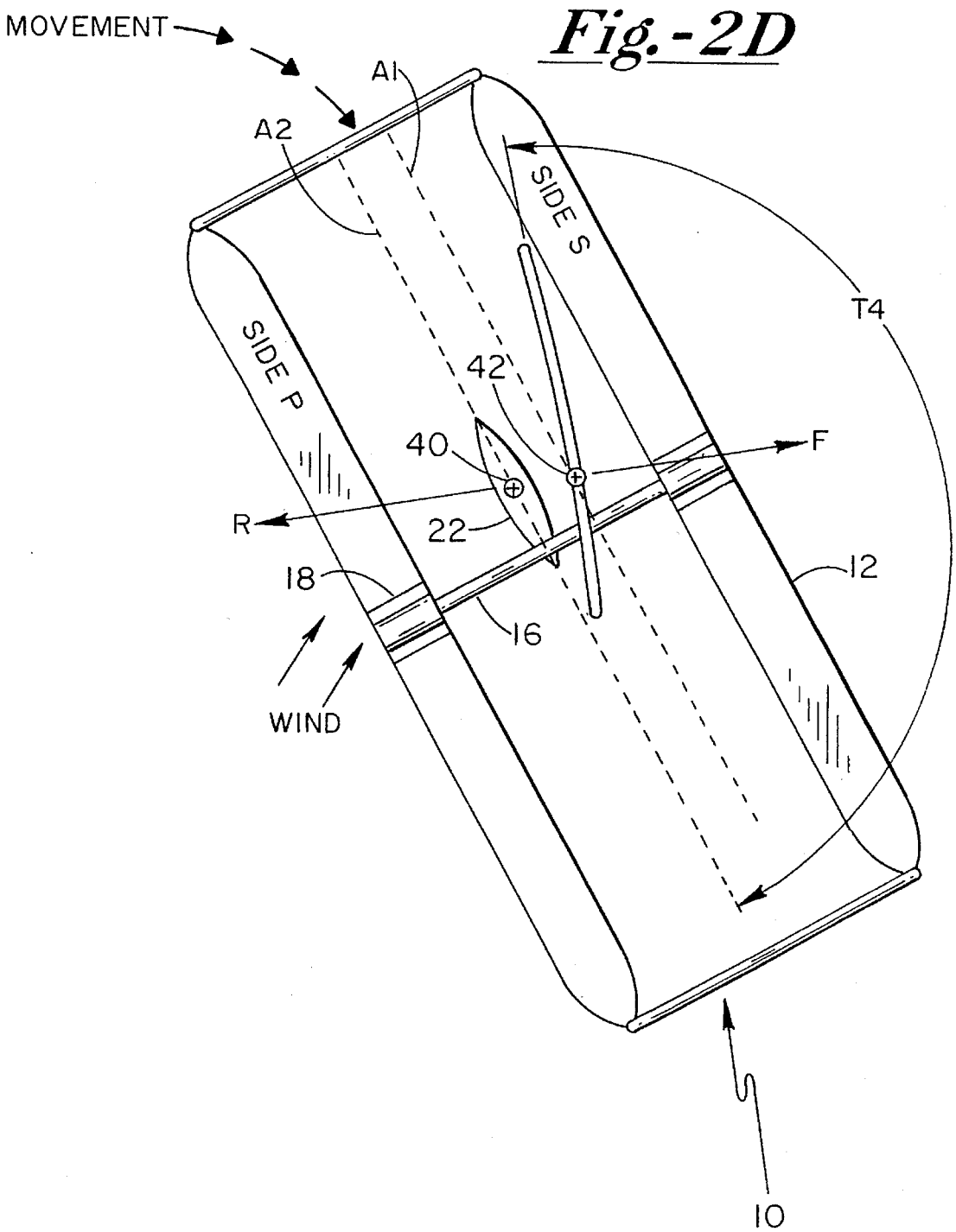
FIG. 2D is a plan view showing the sail rotated fully aback and the sailboat now moving on a new tack with balanced hydrodynamic and aerodynamic force, with side "P" of the craft always remaining the windward side throughout the tack, thus completing the tack aback.

In reference to FIGS. 1 and 2D, the sail 24 is rotated fully aback and mast upper end 20 is tilted slightly forward from that shown in FIG. 2C. Keel 22 is also tilted slightly forward. The hydrodynamic center of force R extending from the center of lateral resistance of keel 22 is generally shown at 52. The aerodynamic center of force F1 is generally shown at 54 and extends from the sail center of effort (CE). These forces are equal and opposite. The sailboat now moves on a new tack with substantially balanced hydrodynamic and aerodynamic force, and slight clockwise movement.

If the wind is assumed to come from starboard rather than port and impinge upon the other side of sail 24 shown in FIG. 1, tilting the mast 20 forward with corresponding tilt rearward of the keel 22 will cause the sailboat to steer to port and the bow of the boat will be said to fall-off-the-wind. Tilting the mast 20 rearward with corresponding tilt forward of the keel 22 will cause the sailboat to steer to starboard and the bow of the boat will be said to come-up-into-the-wind.

In summary, at slight tilt forward of mast 20, an equilibrium of sail and keel forces can be found which cause straight forward steering. Greater tilts forward cause the bow of the sailboat to fall-off-the-wind. Greater tilts of mast 20 rearward cause the bow of the boat to come-up-into-the-wind. When the sail and keel forces are no longer in equilibrium, a moment is created causing the boat to turn clockwise or counter-clockwise.

The further mast 20 is tilted forward with corresponding tilt rearward of the keel 22, the greater the moment causing the bow of the boat to fall-off-the-wind. The further mast 20 is tilted rearward with corresponding forward tilt of the keel 22, the greater the moment causing the bow of the boat to come-up-into-the-wind. Very large and effective steering moments result from large angles of tilt, resulting in easy and precise steering. The angle of sail 24 is shown as trim angle T1. This trim angle T1 can be adjusted by rotating sail 24 and sleeve 26 about mast 20 to cause sail 24 to achieve optimum aerodynamic angles of attack relative to the wind.

The total sail area of the sail 24 in the sailboat at 10 will generally be ten square meters or less. Forces generated by this size sail can generally be manually restrained by one or two crew of the sailboat. It is thus intended that tilt of the mast/keel steering system and setting of the sail trim angle can be accomplished manually by crew setting and/or standing on the structure of the sailboat. Lines with block and tackle from the sail boom 30 to the stern of the boat may be employed to relieve some sail forces generated when sailing in excessively heavy winds.

Because of the symmetrical configuration of keel 22 and the corresponding symmetrical configuration of parallel floatation pontoons 12—12, the crew may employ either end of the floatation pontoons 12—12 as the fore-and/or-aft end upon appropriate manipulation of the mast 14 and keel 22. The crew may accomplish such reversal by removal of the keeper pins, removal of mast and keel assembly from the side brackets 18, and rotating the assembly about the mast axis by 180 degrees. Following rotation, each frame member 16 is re-positioned within brackets 18, and the conversion operation is complete.

Figure 3:
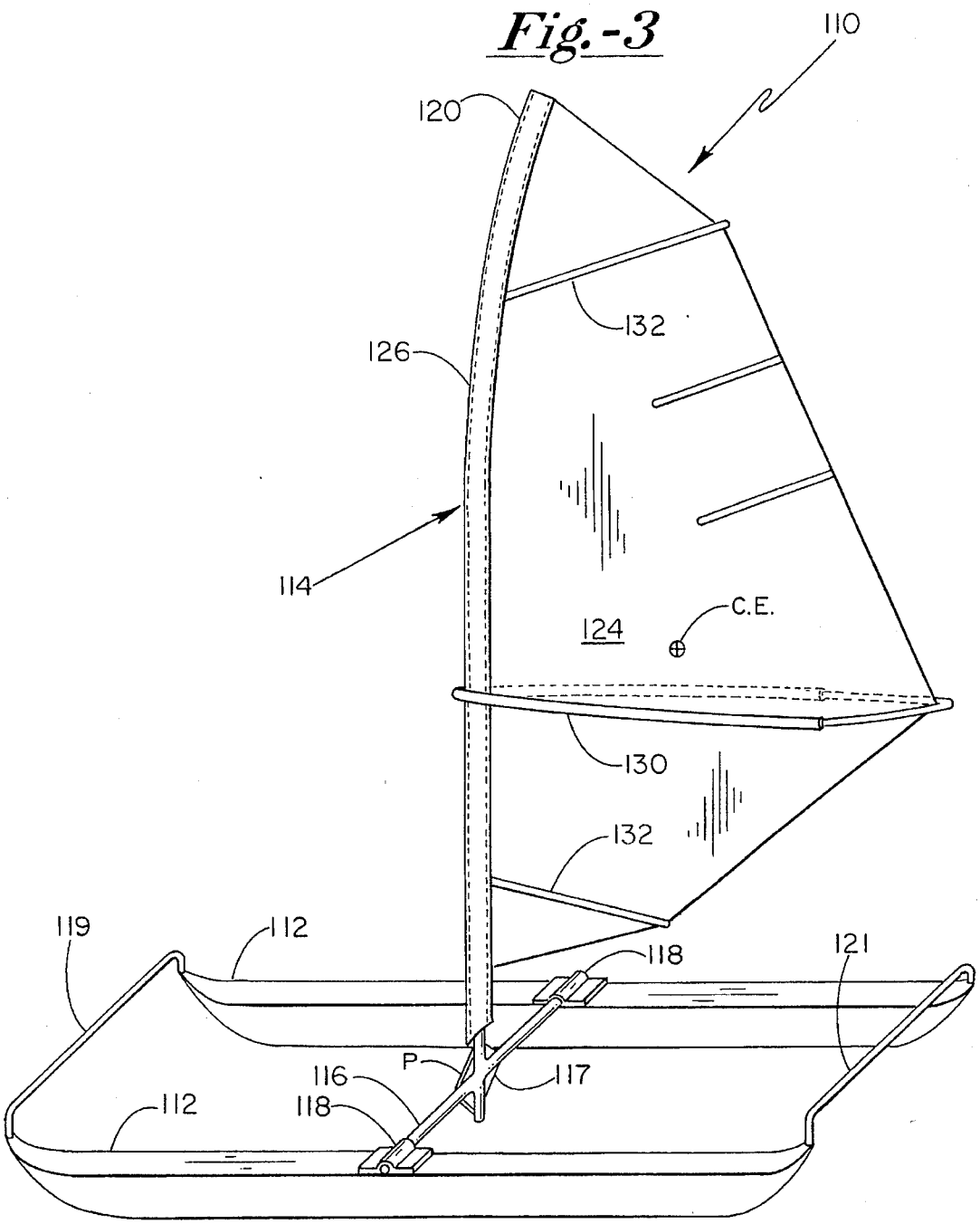
FIG. 3 is an alternative embodiment of a tack aback sailboat which has v-shaped rigid hulls and no keel.

In an alternative embodiment shown in FIG. 3, the sailboat 110 has no keel in addition to no rudder. This sailboat has the identical features of embodiment of FIG. 1 and 2 of a pair of parallel floatation pontoons 112, and a rigid inflatable mast 114 extending upwardly between the pontoons 112. In this embodiment, however, the pontoon hulls are made of a rigid material, such as aluminum, and have a v-shaped cross section as seen in FIG. 3. This embodiment has a rigid mast support 115 includes a pair of opposing rigid frame members 116 rotatably coupled to each pontoon 112. Each member 116 laterally extends from the lower portion of mast support 115 and is secured thereto such as by welding, and includes a gusset 117 providing strength. The opposing distal ends of each frame member 116 are pivotably and rotatably coupled to the upper midsection of the respective pontoon 112. The distal ends are axially disposed through a respective curved bracket 118 secured to the upper surface of the respective pontoon 112, as shown. The distal end of each frame member 16 is restricted from lateral shifting within the respective bracket 118 by a pair of large releasable keeper pins, one pin being disposed through the respective frame member 116 each side of bracket 118. A front tie 119 and a rear tie 121 extend between and are secured to each pontoon 112 to provide torsional strength.

Mast member 114 extends between an upper end 120 and a lower end defined proximate members 116, which lower end terminates at and is secured to gusset 117. When mast 114 is pivoted forwardly, frame members 116 each rotate within respective bracket 118, and the mast upper end 120 correspondingly rotates about pivot point P (see FIG. 3). A sail 124 is secured to a vertically extending flexible mast sleeve 126 along the forward edge of sail 124, as shown. Sleeve 126 is generally tubular being sewn into and consisting of sail cloth, and is selectively disposed over mast support 115 in a friction fit. A sail boom 130 extends rearward on each side of sail 124 along the major surfaces thereof. A plurality of rigid reinforcing members 132 are provided along the rear edges of sail 124, each extending inwardly towards mast 114, as shown, to reinforce sail 124 and along with boom 130, to maintain an open sail surface. The hulls have sufficient resistance to lateral movement in the water so that no keel is necessary in this alternative embodiment. Thus, only the mast and sail need be manipulated in the manner described above to maneuver the sailboat.

This invention has been described herein in considerable detail in order to appropriately disclose the concept to those skilled in the art, and to provide the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For instance, it is to be recognized that a keel can be coupled to a pivoting mast through a gearing arrangement such that the keel pivots proportionally with the mast during rotation, but not necessarily at a correspondingly 1:1 relationship. Any sailboat implementing a mast and keel which can be selectively pivoted fore or aft to create a moment of force to steer the sailboat, is contemplated by the present invention.

What is claimed is:

1. A sailboat, comprising:

(a) hull means having spaced apart bow and stern ends, with longitudinal and transverse axes extending therebetween, and with said hull means being substantially symmetrical about said transverse axis;

(b) an upwardly extending mast means having an upper end and a lower end, said lower end adjustably coupled to said hull means at a pivot point such that said mast means can rotate fore or aft toward said bow and said stern, respectively;

(c) a sail coupled to said mast means;

(d) keel means having a vertical axis extending through the depth thereof, and wherein said keel means is coupled to said mast lower end and movably and positionably rotatable either fore and aft as said mast means is rotated about said pivot point;

(e) and wherein said keel means is symmetrical about said vertical axis; and (f) the arrangement being such that said symmetrical bow and stern ends are interchangeable, one with the other, whereby said sailboat is reversible and can sail in either direction without rotating said bow and stern ends.

2. The sailboat as specified in claim 1 wherein said mast means includes a pair of opposing members each extending laterally from a lower midsection of said mast means to a respective distal end, each said member distal end being coupled to and adjustably positionable with respect to said hull means.

3. The sailboat as specified in claim 2 wherein said hull means comprises a pair of longitudinally extending hulls, wherein each said member distal end is adjustably coupled to one said hull such that said mast means extends upwardly from between said hulls.

4. The sailboat as specified in claim 1 wherein said mast means further includes a laterally extending boom.

5. The sailboat as specified in claim 1 wherein said keel means is securingly coupled to said mast means such that rotation of said mast means creates corresponding rotation of both said mast means and said keel means about said pivot point.

6. The sailboat as specified in claim 1 wherein said mast means is rotatably coupled to said hull means such that said mast means is rotatably fore and aft only.

7. The sailboat as specified in claim 1 wherein said hull means is comprised of an inflatable hull.

8. The sailboat as specified in claim 1 wherein said mast means is rigid.

9. A rudderless sailboat with interchangeable bow and stern ends enabling it to sail in either direction without rotating said bow and stern ends, said sailboat comprising:

(a) hull means having spaced apart bow and stern ends, with longitudinal and transverse axes extending therebetween, and with said hull means being substantially symmetrical about said transverse axis;

(b) an upwardly extending mast means having an upper end and a lower end, said lower end being movably and adjustably coupled to said hull means at a pivot point such that said mast means can rotate fore or aft toward said bow and said stern, respectively;

(c) a sail coupled to said mast means;

(d) keel means having a vertical axis extending through the depth thereof, and wherein said keel means is coupled to said mast lower end and movably and positionally rotatable either fore and aft as said mast means is rotated about said pivot point;

(e) and wherein said keel means is symmetrical about said vertical axis; and (f) the arrangement being such that said bow and stern ends are interchangeable, one with the other, whereby said sailboat is reversible and can sail in either direction without rotating said bow and stern ends.

10. The sailboat as specified in claim 9 wherein said mast means includes a pair of opposing members each extending laterally from a lower midsection of said mast means to a respective distal end, each said member distal end being coupled to and adjustably positionable with respect to said hull means.

11. The sailboat as specified in claim 10 wherein said hull means comprises a pair of longitudinally extending hulls, wherein each said member distal end is adjustably coupled to one said hull such that said mast means extends upwardly from between said hulls.

12. The sailboat as specified in claim 9 wherein said mast means further includes a laterally extending boom.

13. The sailboat as specified in claim 9 wherein said keel means is securingly coupled to said mast means such that rotation of said mast means creates corresponding rotation of both said mast means and said keel means about said pivot point.

14. The sailboat as specified in claim 9 wherein said mast means is rotatably coupled to said hull means such that said mast means is rotatably fore and aft only.

15. The sailboat as specified in claim 9 wherein said hull means is comprised of an inflatable hull.

16. The sailboat as specified in claim 9 wherein said mast means is rigid.

17. A rudderless and keelless sailboat with interchangeable bow and stern ends enabling it to sail in either direction without rotating said bow and stern ends, said sailboat comprising:

(a) hull means having spaced apart bow and stern ends, with longitudinal and transverse axes extending therebetween, and with said hull means being substantially symmetrical about said transverse axis, the arrangement being such that said bow and stern ends are interchangeable, one with the other;

(b) an upwardly extending mast means having an upper end and a lower end, said lower end adjustably coupled to said hull means at a pivot point such that said mast means can rotate fore or aft toward said bow and said stern, respectively;

(c) a sail coupled to said mast means;

(d) said mast means including a pair of opposing members each extending laterally from a lower midsection of said mast means to a respective distal end, each said member distal end being coupled to and adjustably positionable with respect to said hull means.

18. A rudderless and keelless sailboat with interchangeable bow and stern ends enabling it to sail in either direction without rotating said bow and stern ends, said sailboat comprising:

(a) hull means having spaced apart bow and stern ends, with longitudinal and transverse axes extending therebetween, and with said hull means being substantially symmetrical about said transverse axis, the arrangement being such that said bow and stern ends are interchangeable, one with the other;

(b) an upwardly extending mast means having an upper end and a lower end, said lower end adjustably coupled to said hull means at a pivot point such that said mast means can rotate fore or aft toward said bow and said stern, respectively;

(c) a sail coupled to said mast means;

(d) said mast means including a pair of opposing members each extending laterally from a lower midsection of said mast means to a respective distal end, each said member distal end being coupled to and adjustably positionable with respect to said hull means; and (e) said hull means comprises a pair of longitudinally extending hulls and wherein each said distal member end is adjustably coupled to one said hull such that said mast means extends upwardly from between said hulls.

* * * * *